US005150809A

United States Patent [19]

Leigh

[11] Patent Number: 5,150,809

[45] Date of Patent: Sep. 29, 1992

[54] ADJUSTABLE SUBDIVIDABLE MULTI-COMPARTMENT REFUSE CONTAINER

[76] Inventor: William E. Leigh, 205 Lochwood La., West Chester, Pa. 19380

[21] Appl. No.: 679,515

[22] Filed: Apr. 2, 1991

[51] Int. Cl.[5] ..... B65D 25/16

[52] U.S. Cl. ..... 220/404; 220/909; 220/529; 220/533; 220/551

[58] Field of Search ..... 220/909, 404, 533, 551, 220/403

[56] References Cited

U.S. PATENT DOCUMENTS

| | | | |
|---|---|---|---|
| 1,297,190 | 3/1919 | Lawson | 220/551 |
| 3,680,177 | 8/1972 | Ginsberg . | |
| 3,825,150 | 7/1974 | Taylor | 220/404 |
| 3,888,406 | 6/1975 | Nippes . | |
| 4,113,125 | 9/1978 | Schiller | 220/909 |
| 4,294,379 | 10/1981 | Bard . | |
| 4,446,966 | 5/1984 | Moloney | 220/553 |
| 4,576,310 | 3/1986 | Isgar et al. . | |
| 4,577,773 | 3/1986 | Bitel | 220/533 |
| 4,735,340 | 4/1988 | Preston | 220/404 |
| 4,826,013 | 5/1989 | Heikkinen | 220/532 |
| 4,828,133 | 5/1989 | Hougendobler | 220/533 |
| 4,834,262 | 5/1989 | Reed . | |
| 4,867,328 | 9/1989 | McCarthy . | |
| 4,874,111 | 10/1989 | Heller . | |
| 4,893,719 | 1/1990 | Lombardi et al. . | |
| 4,893,722 | 1/1990 | Jones . | |
| 4,905,853 | 3/1990 | Strawder . | |
| 4,964,523 | 10/1990 | Bieltvedt et al. | 220/404 |
| 4,964,528 | 10/1990 | Wagoner | 220/551 |
| 4,974,746 | 12/1990 | Dickinson | 220/404 |
| 4,991,737 | 2/1991 | Edelman | 220/404 |
| 5,050,768 | 9/1991 | Alden | 220/551 |

FOREIGN PATENT DOCUMENTS

| | | | |
|---|---|---|---|
| 3642734 | 6/1988 | Fed. Rep. of Germany | 220/909 |

OTHER PUBLICATIONS

P. 15 of Hammacher Schlemmer Catalog entitled "The Environmentalist's Garbage—Separating Trash Stand."

*Primary Examiner*—Stephen Marcus
*Assistant Examiner*—S. Castellano
*Attorney, Agent, or Firm*—Paul & Paul

[57] ABSTRACT

A refuse receptacle has a main compartment which can be subdivided into smaller sub-compartments by the addition of adjustable panels. Different solid refuse materials can be separately stored in the subcompartments. Grooves and clips are provided to secure removable, flexible liners within the sub-compartments.

17 Claims, 5 Drawing Sheets

ADJUSTABLE SUBDIVIDABLE MULTI-COMPARTMENT REFUSE CONTAINER

BACKGROUND OF THE INVENTION

1. Field of the Invention

This invention relates to a subdividable multi-compartment refuse container, in which the size of the compartments is adjustable.

2. Description of the Prior Art

Solid waste disposal receptacles utilizing flexible liners are known for storing solid refuse. These disposal receptacles can be divided into two types, the single-compartment receptacles and the multiple compartment receptacles.

U.S. Pat. Nos. 4,893,722 ("Jones"), 4,834,262 ("Reed"), 4,893,719 ("Lombardi"), 4,874,111 ("Heller"), 4,904,853 ("Strauder"), and 4,867,328 ("McCarthy") all disclose multiple compartment receptacles.

Jones, Reed, Lombardi, and Heller disclose devices which exhibit fixed size compartments having no adjustability. Each discloses a container for storing solid refuse which employs a flexible liner.

Strauder discloses a cylindrical container having an upper rim used for positioning and retaining flexible liners. The upper rim has radial spokes emanating from a central hub. The liners are retained by the clips on the perimeter of the upper rim, and by clips on the radial spokes. The positioning of the radial spokes is adjustable thereby allowing for differing compartment sizes.

U.S. Pat. Nos. 3,888,406 ("Nippes"), 4,294,379 ("Bard"), 4,576,310 ("Isgar") all disclose a single compartment refuse container for use with a flexible liner. Nippes discloses a collar having multiple layers of liners which unfold into the container. As the container is filled the innermost liner is removed with the contents of the container thereby leaving multiple liners remaining inside the container for subsequent loads.

Bard discloses a device employing air passages running from the bottom of the container to the top which relieve a vacuum created below a liner when the full liner is being removed from the container.

Isgar discloses a device employing slots in an open rim of a container and hooks on the outside side walls of the container. A liner is intended to be folded over a portion of the rim and fit through the slots to be retained by the hooks of the side walls of the container.

A need exists for a sub-dividable multi-compartment refuse container, for separately storing solid refuse materials which secures multiple liners into each of the separate compartments and facilitates ease of removal of the container contents.

There is also a need for a receptacle which employs a magnetic detection means to differentiate between recyclable and non-recyclable metals.

SUMMARY OF THE INVENTION

A subdividable multi-compartment receptacle for use with flexible liners for separately storing different solid refuse materials is provided by the present invention. A container having an open end, an inside surface, and at least one side wall defines a compartment. A plurality of partition panel retaining means may be attached to the inside surfaces of the container. At least one partition panel is provided having a top edge, bottom edge and pair of side edges, said panel being held in place by the partition panel retaining means. Partition panels are positioned within the container such that the panels subdivide the compartment into subcompartments. Each panel may itself also be fitted with partition panel retaining means which accommodate the side edges of other panels allowing for further subdivision of the compartments wherein said other panels may be adjustably provided. Grooves are provided in the upper portions of the container side walls as well as partition panels. Each compartment or sub-compartment may receive at least one flexible liner which, for example, at the groove may be folded over the open end of the container and any adjacent partition panel. Clips having a tongue portion may also be provided to fit over the trash liner and secure the liner to a side wall or partition. The tongue of each clip is shaped to fit into any of the grooves of the container side wall and panels. A lid may also be provided to cover the open portion of the container.

It is a principle object of the present invention to provide an adjustable subdividable multi-compartment refuse container for separately storing various types of refuse therein.

It is a further object of the present invention to provide partition means for subdividing the container into separate compartments.

It is a further object of the present invention to provide multi-positionable liner retaining means for securing liners within a compartment.

Another object of the present invention is to provide magnetic means for identifying certain recyclable materials.

It is a further object of the invention to provide a container having insertable compartment dividers which may be adjusted to alter the size of the compartments.

It is another object of this invention to provide compartment dividers which themselves are adjustable for insertion at various positions within the container.

It is another object of the present invention to accomplish any of the above-mentioned object wherein a container compartment is provided with vacuum relief means.

Another object of the present invention is to provide a container lid having self hinging means.

It is a further object of the present invention to provide lid means for a compartment which is independently openable in relation to other compartment lid means.

Other objects and advantages of the present invention will be apparent to those skilled in the art from a reading of the Brief Description of the Drawings, Detailed Description of the Preferred Embodiments and the appended claims.

DETAILED DESCRIPTION OF THE PREFERRED EMBODIMENTS

Figure 1:
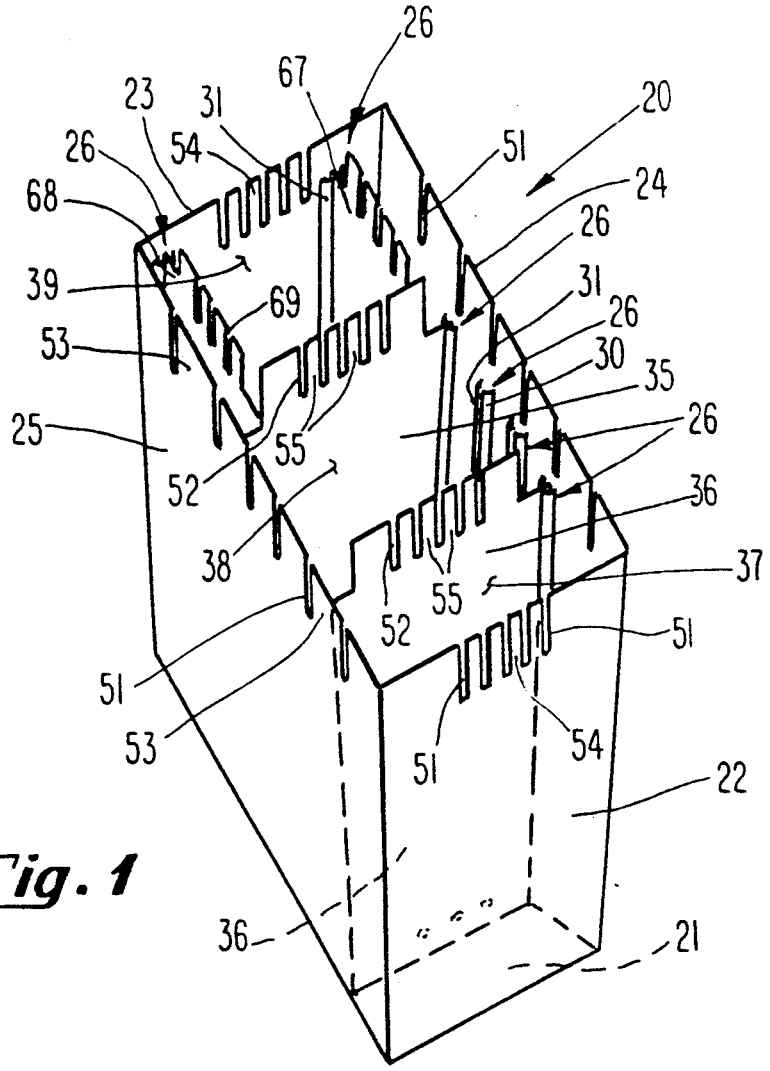
FIG. 1 is a parallel perspective view of the adjustable subdividable multi-compartment refuse container.

Referring now to the drawings in detail, wherein like reference numerals indicate like elements in each of the several views, unless otherwise specified, reference is made to FIG. 1 which shows an adjustable subdividable multicompartment refuse container 20. The container 20 is shown comprising a base 21, and side walls 22, 23, 24, and 25 which extend vertically from said base 21 to define the perimeter of the container 20. Side walls 22, 23, 24, and 25 are each provided having inner and outer surfaces and a top edge. A plurality of partition panel retaining means, generally designated by the numeral 26, are disposed on the inner surfaces of said container side walls 22, 23, 24, 25, and may preferably comprise a pair of runners such as those 30, 31 (see FIG. 2) which are attached to the inner surface of any of container sidewalls 22, 23, 24, 25. Each runner 30, for example, is disposed longitudinally parallel to another runner 31, thereby forming a slot 32 between said runner pairs. Runners 30, 31 may be provided comprising flat wall construction to form a slot of generally U-shaped configuration (not shown), or, for example, may be provided comprising walls having inturned edges such as those 30 and 31 of the preferred embodiment shown in FIG. 2. At least one, and preferably more than one partition panel 35 and 36 is provided in order to divide the container into multiple compartments, such as those 37, 38 and 39, wherein separate items of recyclable or non-recyclable materials may be stored. The partition means preferably comprises partition panels such as those 35 and 36 of FIG. 1, with each panel 35, 36 having a pair of panel faces, a top edge, a bottom edge, and a pair of side edges. The preferred panel embodiment, as illustrated by panel 35, is fitted with a pair of panel retaining means 41 (seen in FIG. 2). Panel side edges 42 and 43 may, for example, be provided with a T-like configuration for sliding receipt within any of the slots 32 defined by the opposing inner wall surfaces of runners 30 and 31. At least two, and, preferably, many panel retaining means 26, are disposed on the inner surfaces of side walls 24 and 25 to allow adjustability of compartment size by positioning panels 35, 36 at various locations within the container. Preferably, each panel retaining means is disposed to face a panel retaining means on an opposing wall or panel face to permit the side edges of a single panel to be received in opposing panel retaining means.

Figure 2:
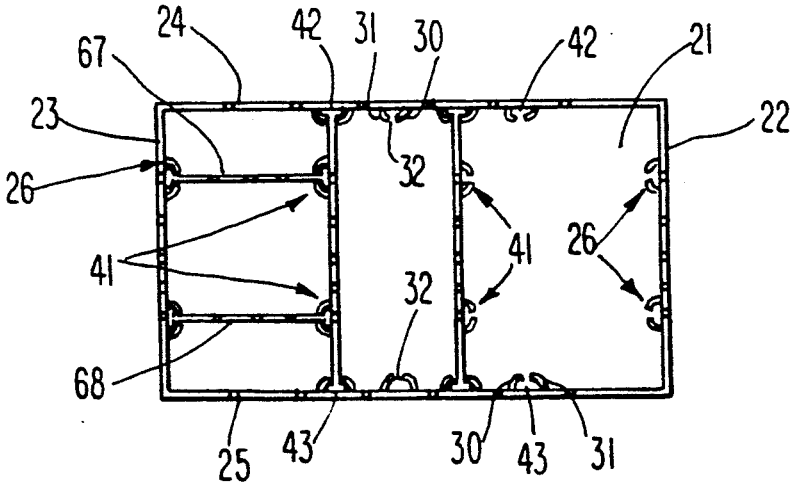
FIG. 2 is a top plan view of the container shown in FIG. 1.
Figure 3:
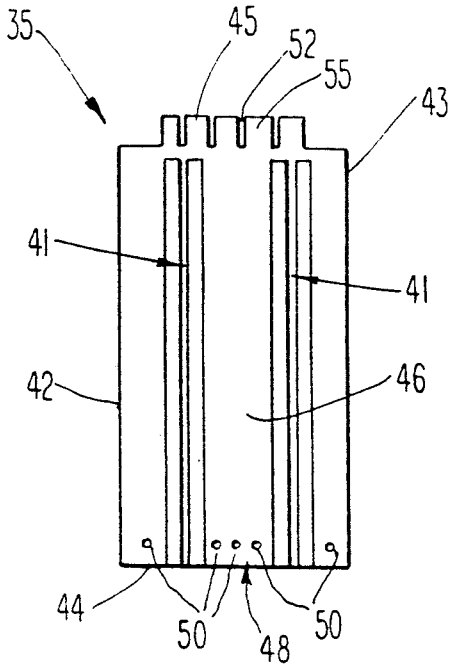
FIG. 3 is a front elevational view of a partition panel shown in FIGS. 1 and 2.

FIG. 3 shows a partition panel embodiment having a rectangular configuration, such as that 35 of FIGS. 1 and 2. The panel 35 preferably comprises a pair of side edges 42 and 43, a bottom edge 44, a top edge 45, and a pair of panel faces, only one of which 46, is shown. The panel 35 is provided with panel retaining means 41 which are disposed on said panel face 46 and which may also be disposed on the other panel face (not shown). The portion of the panel proximate to the bottom panel edge is provided with vacuum relief means 48, including at least one, and preferably, several apertures 50 for allowing the passage of air through the panel 35. The vacuum relief means 48 allows air to pass from one compartment chamber such as, for example, that 39, to another compartment chamber 38, for example, when removing a liner (such as that shown in FIG. 6) from a container compartment. Ordinarily a vacuum is created upon removing a full or partially full liner from a compartment, making removal of liners difficult. The passage of air facilitates the removal of a full, or partially full liner from a container compartment 37, 38, 39 by eliminating, or at least, substantially reducing the vacuum created in the void between the exterior of the liner and the interior of a compartment.

As seen in FIG. 1, liner retaining means are shown comprising a plurality of grooves 51 which are provided in the container side walls 22, 23, 24, 25 proximate the top portion of each side wall. Likewise, similar grooves 52 are also provided proximate the top portion of the panels 35, 36 which divide the container into compartments 37, 38, 39. The grooves 51 and 52 extend longitudinally from the top edge of each side wall 22, 23, 24, 25 or panel 35, 36, partially to said container base 21. Slats 53 are formed in the top portion of each container side wall 24, and 25, and slats 54 are formed in the top portion of each side wall 22 and 23, each slat 53, 54 being defined by a pair of side wall grooves 51 on opposite sides thereof. Likewise, slats 55 are also formed in the top portion of any of panels 35 and 36, said slats being defined by a pair of panel grooves 52.

Figures 9, 10:
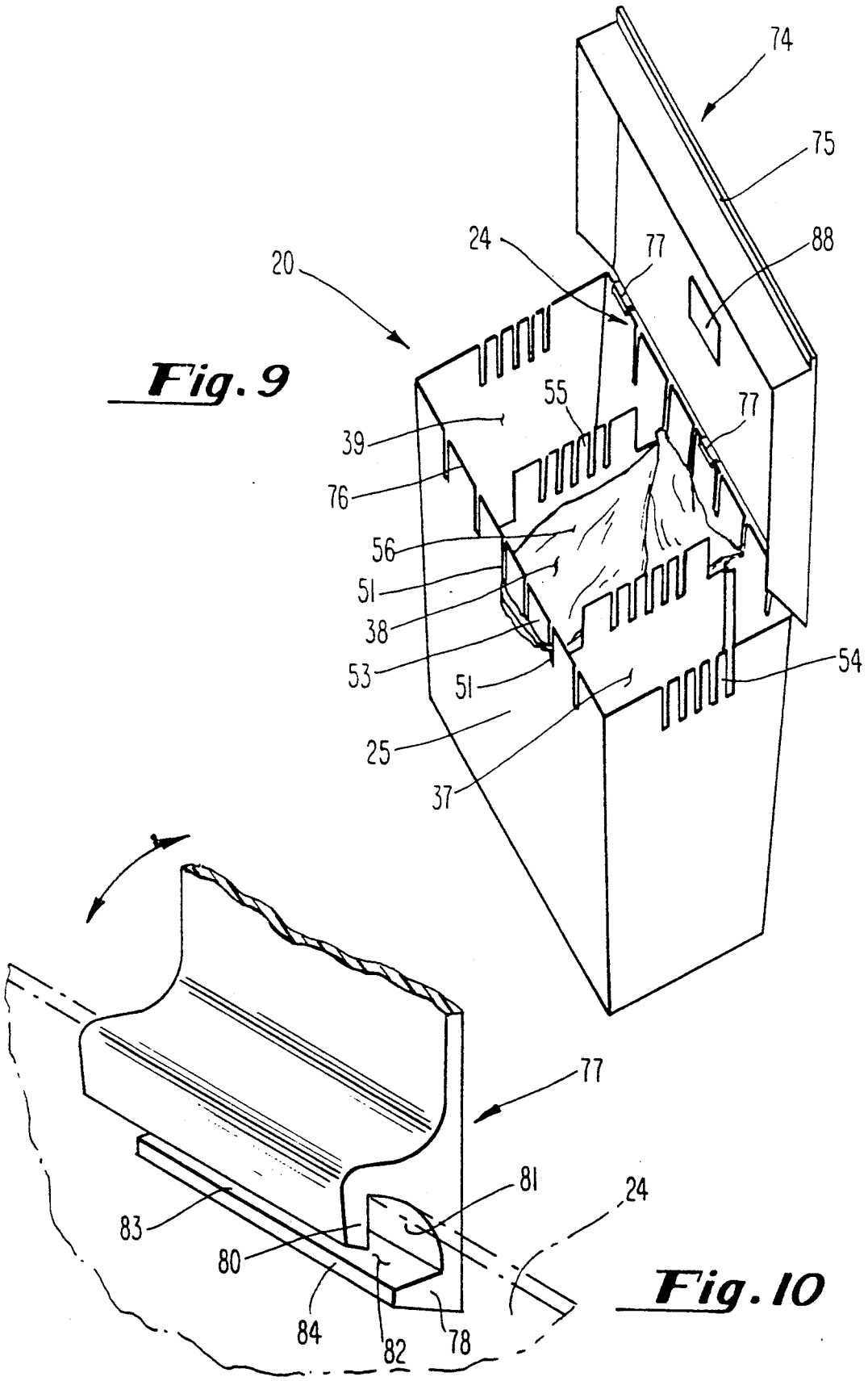
FIG. 9 a parallel perspective view of a container embodiment with a self-hinging lid.
FIG. 10 is an enlarged parallel perspective view of the lid hinge of FIG. 9.

As seen in FIG. 9, grooves 51 may support a turned over edge of a plastic liner 56 for example or may receive plastic liner handles therethrough, wherein said handles may be disposed about any of slats 53, 54, and 55. Liner handles, for example, may be any of those which are part of a commercially available liner product. The slats such as those 55 formed by the grooves 52 of panel 35, may also be employed for liner retaining purposes consistent with the operation of the side wall slats, described above. Grooves may be disposed such that at least one groove is positioned above each panel retaining means.

Figure 5:
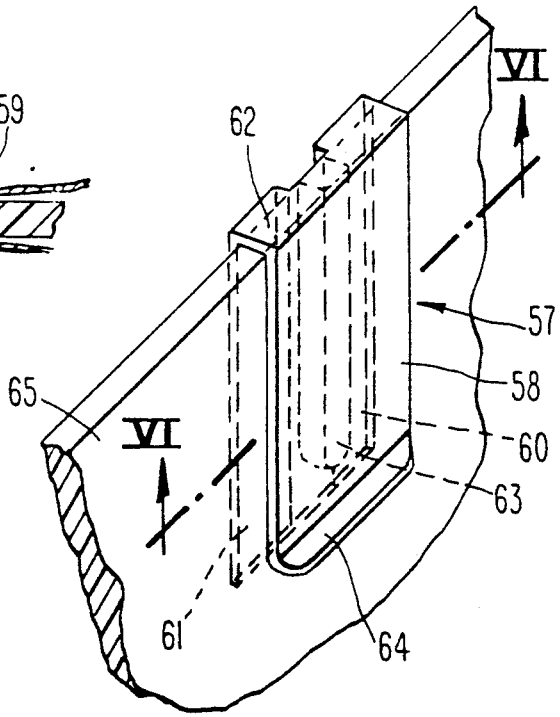
FIG. 5 is a parallel perspective view of a clip member used for securing flexible compartment liners.

Referring to FIG. 5, the preferred embodiment of the liner retaining means clip member 57 is shown comprising a first wall 58 and a pair of resiliently movable spaced-apart leg portions 60 and 61. The first wall 58 and the leg portions 60 and 61 are attached to a connecting wall 62 to form the clip member 57 which is of generally U-shaped configuration. The first wall 58 has a flanged end portion 64 opposite its connected end. The flanged end 64 permits manual gripping or lifting of the clip member 57. When installing or removing a liner, the flanged end 64 may also be lifted to force the first wall 58 apart from the leg portions 60, 61 in order to fit the clip 57 over a liner. The clip member 57 is also provided with a tongue portion 63 which is longitudinally disposed on the inner surface of said first wall 58, and extends from the inner surface of said connecting wall 62, partially to the first wall flanged end 64.

Figure 6:
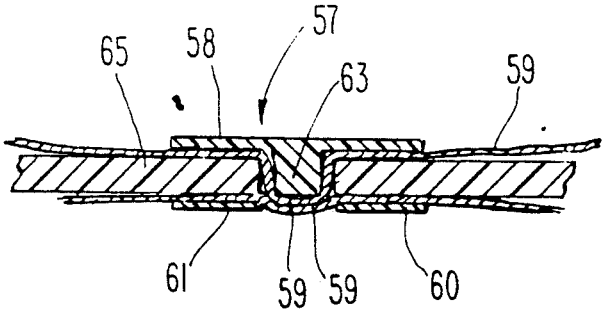
FIG. 6 is a horizontal sectional view of a clip member taken along the line VI—VI of FIG. 5.

Referring now to FIG. 6, a flexible liner 59 is placed over a wall or panel groove, and a clip member 57 may then slidingly be placed over the liner such that the tongue portion 63 of said clip 57 is received within a groove, the liner 59 being held between said panel or sidewall groove and said clip member 57, said liner 59 being maintained, in part, between the inner surface of said first wall 58 and mounting surface 65, said mounting surface 65 generally representing any of the inner surfaces of container side walls 22, 23, 24, 25, or any of the partition panel, surfaces such as, for example, those shown and described in FIG. 1. For added stability, a liner 59 may be folded-over a panel or side wall edge such that leg portions 60 and 61 hold the folded-over liner portion against a panel or sidewall surface 65. Although, not shown a number of clip members 57 may be used to secure a single liner in place to afford the capability of retaining the liner in an open condition for receipt of refuse therein. The clips 57 may be installed at any groove location to secure multipositionable liner partitions within a container compartment. The liner 59 employed may comprise any suitable size, shape or strength material, such as, but not limited to, for example, commercially available plastic trash bags.

Consistent with the aforementioned operating principles and features of partition panels 35 and 36, second partition panels 67, 68, as seen in FIGS. 1 and 2, may also be provided for further subdividing all or any of the compartments, such as, for example that 39 formed by the addition of at least one, first panel 35 to the container. Second panels 67, 68 are shown disposed between a first panel 35 and a container side wall 23, and are held in place by panel retaining means 26 of the side wall and panel retaining means 41 of the first panel face (FIG. 2). Although, not shown, it is understood, however, that any of second panels 67, 68 may also be disposed between a pair of first panels, such as, for example, those 35 and 36, in order to further divide or size down the compartment 38, and that panel retaining means may be provided on both front and rear first panel faces as well. The addition of second panels 67, 68 enables narrow tailoring of a compartment's dimension to suit the application employed therein. For example, if a small compartment is desired for certain refuse items, the use of second panels, such as those 67 and 68, permits a compartment to be sized down.

A plurality of grooves generally designated by the numeral 69 are shown in the top of second panels 67, 68. The grooves 69 also function to support a liner or liner handle in an analagous manner as do the grooves 51 and 52 described above.

Figure 4:
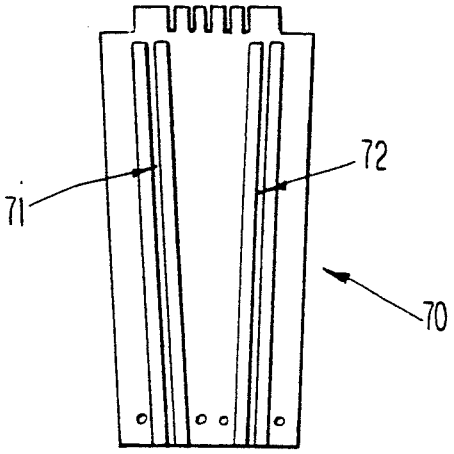
FIG. 4 is a front elevational view of an alternate partition panel embodiment.

Additionally, as seen in FIG. 4, panels, such as that designated by the numeral 70, may be provided being of a tapered configuration for receipt in a refuse container having a pair of tapered side walls (not shown) fitted with panel retaining means for slidably mounting and holding the tapered panel 70 in place. The panel retaining means for the tapered panel application preferably comprise a pair of runners, each said runner having flat wall construction to form a slot of generally U-shaped configuration, wherein a tapered panel edge may be slid into position. FIG. 4 also shows panel retaining means 71 and 72 angularly disposed such that the distance between said pair of panel retaining means 71 and 72 decreases from top to bottom of said panel length. The angular disposal of said panel retaining means 71 and 72, although shown employed on a panel of tapered configuration 70, may also be furnished on panels having rectangular configuration, such as, for example, any of those 35 or 36 of FIG. 1. Any of the panel retaining means 26 (FIG. 1) located on the inner surfaces of container side walls 22, 23, 24, 25, although shown disposed parallel in relation to a container sidewall edge, may, in an alternate embodiment (not shown), be provided in angular relation to any sidewall edge to face panel retaining means disposed opposite therefrom, thereby allowing a panel to be maintained in angular relation to any said container side wall.

Any of the first panels 35 or 36 may be provided with at least one angularly disposed panel retaining means thereon, which may retain a second panel therein in suitable angular relation to a container wall or any other panel, such that the formed compartment, defined in part by at least one angled second panel, is of a tapered configuration, said bottom dimension being perimetrically smaller than said top dimension of said formed compartment. The tapered configuration facilitates the removal of a filled or partially filled liner by preventing the liner contents from forcing the liner against the compartment wall during removal. If a liner is forced against a compartment wall by the contents therein, the at least one angled side of the compartment aids in providing leverage when removing a filled or partially filled liner. It will be understood that a pair of second panels may each be provided in angled relation to form a wedge-shaped compartment with similar features and benefits described above.

Second panels, such as any of those 67, and 68 may be provided with panel retaining means (not shown) on either or both of their faces. The panel retaining means of the second panels may secure third panels (not shown) which may be provided for further sizing or division of a compartment such as that 39, defined, in part, by second panels 67, 68 shown in FIGS. 1 and 2.

Figure 8:
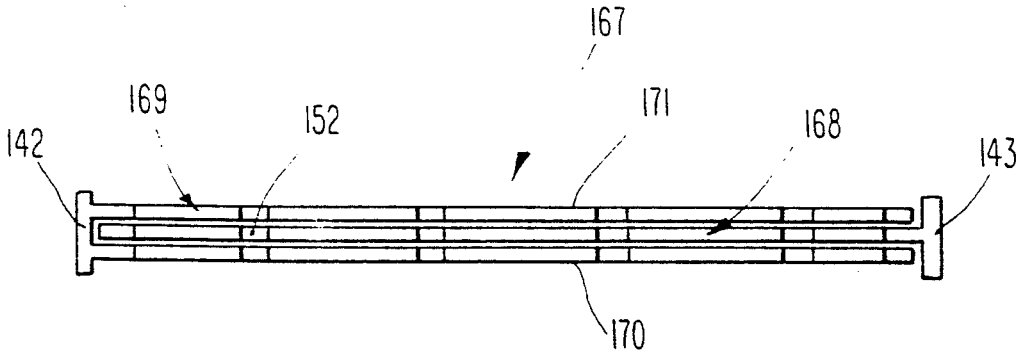
FIG. 8 is a top view of the alternate panel embodiment of FIG. 7.
Figure 7:
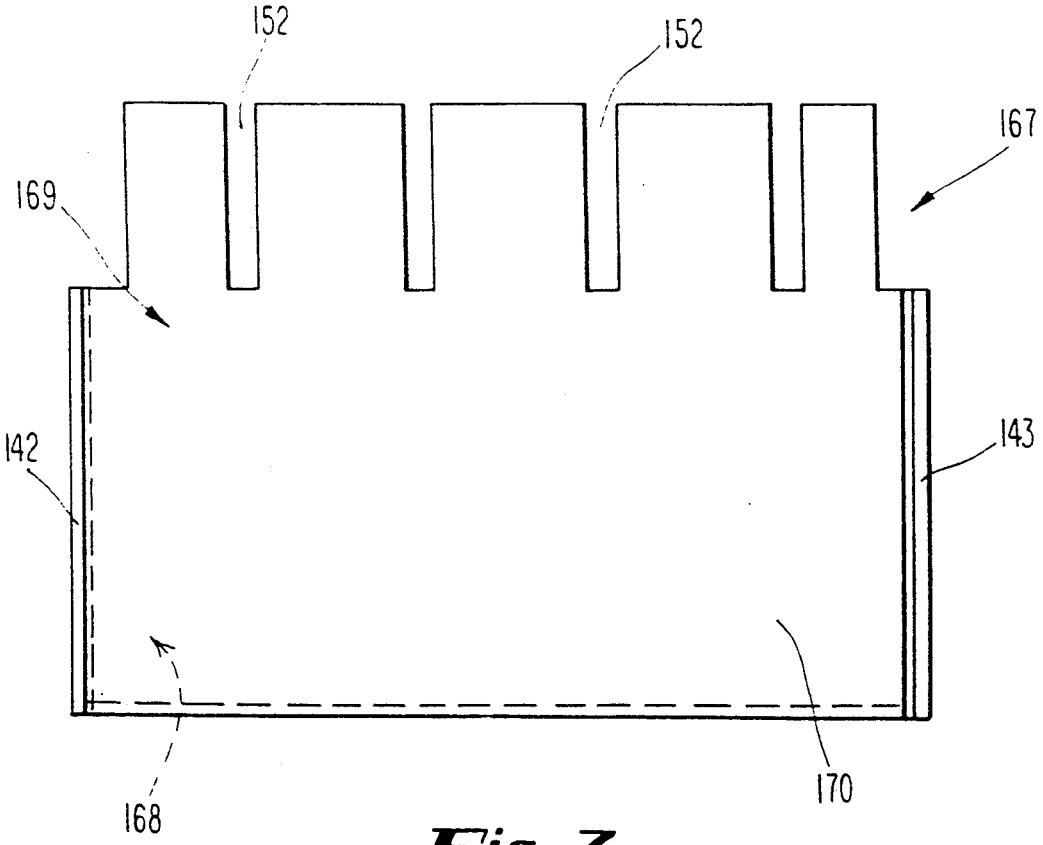
FIG. 7 is an enlarged front elevational view of an alternate second partition panel embodiment.

FIGS. 7 and 8 show the preferred embodiment of an adjustable second panel 167, having an inner panel member 168 and an outer panel member 169, said outer panel member including a pair of opposing spaced-apart side walls 170, 171 which are attached by a connecting portion (not shown) to form a generally "U-" shaped groove therein, at least part of said inner panel 168 being slidably carried within said outer panel member 169. A pair of panel edges 142, 143 are shown provided at opposite ends of said adjustable panel 167 for receipt within panel retaining means, such as any of those 26 of the side walls 22, 23, 24, 25, or 41 of the first panels 35, 36.

Grooves 152 are preferably provided in the top portion of each adjustable panel 167. The grooves may, for example be furnished at locations along inner and outer panel members 168 and 169, respectively, such that when a second panel 167 is installed within the container 20, the grooves of each panel member are uniformly aligned, as shown in FIG. 7. This may be achieved by taking into account the spacing distance between the panel retaining means 26 which ar located along the container sidewalls 24 and 25. Alternatively, the inner panel member 168 may be provided shorter in height in relation to the outer panel 169. This dimension would enable associated clip members 57, to be used therewith, as described above. The adjustable pane 167 may be used consistent with the application of the second panels 67, 68 described above. However, the adjustment capability of panel 167 permits the panel 167 to be used with a first panel being installed at any of a variety of positions within the container 20. The adjustable panel 167 can be opened to the desired width and installed within the container 20.

FIG. 9 shows a container 20 with a lid 74 in its open position. When closed, the lid 74 covers the top edges of container side walls 22, 23, 24 and 25 and the compartments 37, 38 and 39. The lid 74 has a ledge portion 75 which extends beyond the top edge 76 of container side wall 25 and acts as a handle. The lid 74 is attached to side wall by self-hinging means 77 which is shown enlarged and with more particular detail in FIG. 10. The self hinging means 77 comprises a hinge ridge 78, a hinge stop 80, and a guide surface 81. The self hinging means 77 further comprises a slot 82 disposed between said hinge stop 80 and said hinge ridge 78, and defined, in part, by guide surface 81. The side wall 24 of the container 20 is received in slot 82, thereby enabling the attachment of said lid 74 to the container 20. The hinge ridge 78 is provided with a retaining surface 83 which remains in contact with the side wall 24 when said lid 74 is in its down or closed position (not shown). As the lid 74 is lifted away from the top edge 76 of the container side wall 25 to its open position, the guide surface 81 slides along the top edge of side wall 24, until the stopping surface 84 of hinge stop 80 contacts the outer surface of side wall 24. The lid 74 may therefore be reciprocally pivoted about the top edge of side wall 24 to open or close said lid 74 as is necessary, the pivoting operation being consistent with the aforementioned hinging operation. A magnetic means 88 may be superficially attached to any container side wall or lid such as that 74 shown in FIG. 9. The magnetic means 88 allows the user to touch metal refuse to said means 88 in order to determine the magnetic qualities of the metal, and possibly to aid in the categorization of refuse material into recyclable and non-recyclable components.

Figure 11:
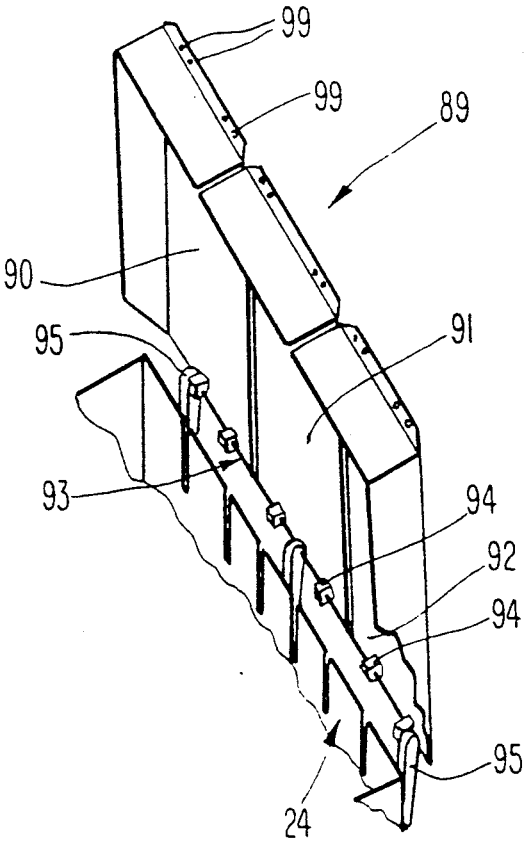
FIG. 11 is a fragmentary parallel perspective view of a container embodiment and an alternate lid embodiment having independently pivotable lid panel sections.

FIG. 11 discloses an alternate embodiment of the lid and hinge means of the present invention. In this embodiment the lid 89 is comprised of three panels 90, 91 and 92. Each panel 90, 91 and 92 is provided with separate hinges which receive rod 93 therethrough, thereby allowing independent reciprocal pivoting of any of the three panels 90, 91 and 92 about said rod 93. The rod 93 is maintained by at least two, and preferably three, rod support members 95 which are attached to side wall 24. In addition, label retaining means comprising a pair of bores 99 are shown on the edge of each panel 90, 91, and 92. A label holder and labels (not shown) may be provided to be fitted in the bores 99, to enable separate identification of the contents of each compartment.

Figure 12:
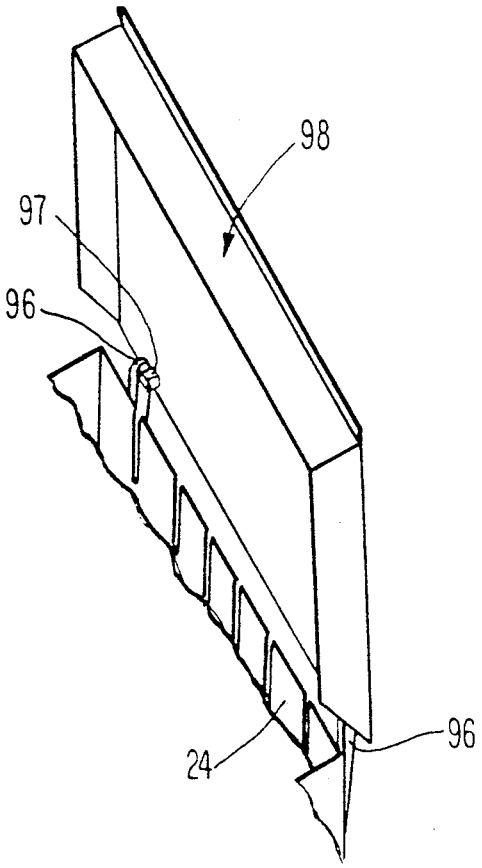
FIG. 12 is a fragmentary parallel perspective view of a container shown with an alternate lid embodiment.

FIG. 12 shows a lid 98 with an alternate hinging embodiment. A pair of pivotal pin support members 96 are provided attached to container side wall 24, said pin support members 96 each having a female bore therein (not shown) for receiving a male pin member (not shown) of a hinge anchor member 97. It is noted that support members 95 (FIG. 11.) and 96 (FIG. 12) may be similar, and possibly, identical members depending upon the size of the rod 93 (FIG. 11) or pin member employed therein.

Figure 13:
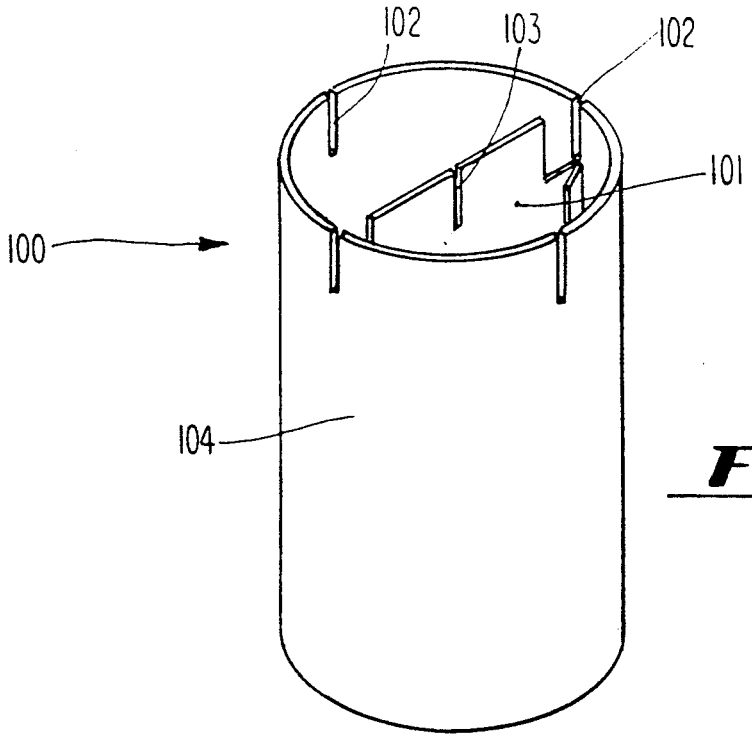
FIG. 13 is a parallel perspective view of an alternate container embodiment having single side wall construction.

An alternate container embodiment 100 is shown in FIG. 13 having a single side wall 104. The container is shown with a removable panel member 101, and a plurality of grooves 102, 103 similar to those 51 and 52 shown in container side walls and panels of FIG. 1. The grooves 102 and 103 may receive and retain liners consistent with the application of the above-mentioned grooves associated with the walls and panels of container 20. Although associated clip members such as those 57 shown in FIG. 5, are not shown, it is understood that preferably they may be used with the container 100. No lid is pictured with container 100, but it is understood that a lid may be furnished consistent with the description of this invention.

It is further understood from reading the above description that although the drawings show a specific number of panel retaining means positioned at various locations along the container sidewalls and panel faces, any number of panel retaining means may be provided at various locations along the container sidewalls or panel surfaces. Likewise, in addition to the panel arrangements shown in the drawings, other panel arrangements, including those comprising additional or fewer panels, may also be employed within the scope of this invention.

What is claimed is:

1. An adjustable subdividable multi-compartment refuse container for use with multiple flexible liners, the container comprising:

(a) a base and at least two pairs of opposing side walls extending perpendicularly therefrom, the side walls each having an inner and outer surface, a top edge portion, and a bottom edge portion, the container being open at an end opposite said base;

(b) a plurality of panel retaining means located on the inner surfaces of the side walls;

(c) at least one removable first panel having front and back panel faces, a top edge, a bottom edge, and a pair of side edges, the side edges being held in place by the panel retaining means, the at least one first panel dividing the container into separate multi-sizable compartments;

(d) liner retaining means comprising a plurality of grooves disposed in the top edge portion of at least one pair of opposing container side walls; and (e) at least one generally U-shaped clip member having a first wall opposing a pair of spaced-apart resiliently movable leg members, each leg member being attached at one end thereof to a connecting wall, the first wall having a tongue portion extending from the connecting wall lengthwise along the inner surface of the said first wall and disposed opposite the space between the leg members, the tongue portion being adapted to be slidably received within any of the grooves, whereby when a liner is placed over any groove, upon sliding receipt of the clip member tongue portion within the groove the liner is secured in place.

2. The container of claim 1, wherein said liner retaining means further comprise a plurality of grooves disposed in the top edge of said at least one removable first panel.

3. The container of claim 1, wherein said panel retaining means comprise a pair of runners longitudinally disposed on said inner wall surfaces, defining a slot therebetween for receiving one of said panel side edges therein.

4. The container of claim 3, wherein any said panel side edge is generally T-shaped and wherein any said pair of runners is each provided having a pair of side edges with one runner side edge being connected to a side wall inner surface, and with the other runner side edge protruding therefrom into the container space, each said protruding runner side edge being inturned to face an opposing protruding runner side edge of another runner, said T-shaped panel edge being adapted to be received within the slot defined by said pair of runners.

5. The container of claim 1, wherein said first panel faces are provided with a plurality of panel retaining means thereon.

6. The container of claim 5, further comprising at least one removable second panel having front and back panel faces, a top edge, a bottom edge, and a pair of side edges, wherein said second panel is positioned between said at least one removable first panel and one of said container side walls, said second panel being secured at each side edge thereof by said panel retaining means.

7. The container of claim 5, further comprising at least two removable second panels each having front and back panel faces, a top edge, a bottom edge, and a pair of side edges, wherein said second panels are positioned between said at least one removable first panel and one of said container side walls, said second panels being secured at each side edge thereof by said panel retaining means, said second panels further dividing said multi-sizable compartments into at least one subcompartment.

8. The container of claim 1, wherein said at least one removable first panel is comprised of two said panels, wherein said first panel faces are provided with a plurality of panel retaining means, and wherein said first panel side edges are T-shaped, said container further comprising at least one removable second panel having front and back panel faces, a top edge, a bottom edge, and a pair of T-shaped side edges, wherein the second panel T-shaped side edges are received in said first panel retaining means.

9. The container of claim 1, further comprising means for magnetizing attached thereto for determining the magnetic properties of materials for aiding the sorting of metal containing refuse.

10. The container of claim 1, including means for displaying labels above each compartment to identify the contents of the compartment.

11. The container of any one of claims 6 or 1, with vacuum relief means including a plurality of apertures provided in said first panel proximate said first panel bottom edge and extending entirely through said first panel to allow the passage of air between compartments, thereby relieving the vacuum created when said liners in their filled or partially filled condition are removed from said compartments.

12. The container of claim 6, wherein at least one of said plurality of panel retaining means provided on the first panel faces and at least one of said plurality of panel retaining means located on an inner side wall surface are provided in substantial angular relation to said first panel side edges whereby the side edges of at least one second panel are received therein, said second panel being maintained in substantial angular relation to said container side wall surface to form a sub-compartment having a tapered configuration with the dimension of said sub-compartment nearest the container base being smaller than the sub-compartment dimension nearest said open end.

13. The container of claim 1, further comprising a lid for covering the open end of said container.

14. The container of claim 13, wherein said lid is comprised of a plurality of lid sections each covering a portion of the open end of the container, with each said lid section being independently openable in relation to any other lid section hinged to the container.

15. The container of claim 6, wherein said at least one second panel is provided having a plurality of panel retaining means longitudinally disposed thereon, said container further comprising at least one removable third panel having front and back panel faces, a top edge, a bottom edge, and a pair of side edges, wherein at least one side edge of said third panel is secured by one of said plurality of panel retaining means located on said at least one second panel, thereby further sub-dividing said container.

16. The container of claim 13, wherein said lid has self-hinging means for accommodating a container side wall top edge portion therein and pivoting about said top edge portion, said self-hinging means including:

a hinge ridge for limiting pivotal motion of the self-hinging means in one direction relative to said container side wall;

a hinge stop for limiting pivotal motion of the self-hinging means in a second direction relative to the side wall;

a curved guide surface beginning at the hinge ridge and extending to the hinge stop for receiving said side wall top edge portion and allowing reciprocal pivoting of said guide surface about said side wall top edge portion;

the self-hinging means resting on the side wall allowing the lid connected to the self-hinging means to be lifted off and replaced without disassembly of said lid.

17. The container of claim 16, wherein said lid is provided with means for magnetizing for aiding the separation of recyclable materials.

* * * * *